US006672942B1

(12) United States Patent
Ikeda et al.

(10) Patent No.: US 6,672,942 B1
(45) Date of Patent: Jan. 6, 2004

(54) GRINDING MACHINE FOR WELDING ELECTRODES

(75) Inventors: Nobukazu Ikeda, Osaka (JP); Akihiro Morimoto, Osaka (JP); Katunori Komehana, Osaka (JP); Teruo Honiden, Osaka (JP)

(73) Assignees: Fujikin Incorporated, Osaka (JP); Japan Science and Technology Corporation, Saitama (JP)

( * ) Notice: Subject to any disclaimer, the term of this patent is extended or adjusted under 35 U.S.C. 154(b) by 132 days.

(21) Appl. No.: 10/009,323

(22) PCT Filed: Nov. 6, 2000

(86) PCT No.: PCT/JP00/07794

§ 371 (c)(1),
(2), (4) Date: Oct. 13, 2001

(87) PCT Pub. No.: WO02/40219

PCT Pub. Date: May 23, 2002

(51) Int. Cl.[7] ..... B24B 49/00
(52) U.S. Cl. ..... 451/11; 451/48
(58) Field of Search ..... 451/11, 47, 48, 451/178

(56) References Cited

FOREIGN PATENT DOCUMENTS

| | | | |
|---|---|---|---|
| JP | 2511525 | 9/1996 | |
| JP | 7-276211 | * 10/1996 | ..... B24B/19/16 |
| JP | 9-234656 | * 9/1997 | ..... B24B/5/14 |
| JP | 2568231 | 4/1998 | |
| JP | 2577570 | 7/1998 | |

* cited by examiner

*Primary Examiner*—Dung Van Nguyen
(74) *Attorney, Agent, or Firm*—Griffin & Szipl, P.C.

(57) ABSTRACT

A grinding machine for welding electrodes comprises a housing 1, grinder motor 2, grinding disk 3, swing plate 4, holder guide 6, electrode holder 7, electrode turning motor 8 and swing plate moving mechanism 9. The axis ϕa of electrode A extends along a line perpendicular to the axis ϕ of motor drive shaft 2*a* and first grinding part 3*a* of the grinding disk is formed to conform to the finishing contour of electrode A. The grinding disk is turned by the grinder motor and at the same time electrode A is turned by the electrode turning motor. The grinding machine, using one grinding disk, grinds the end portion of an electrode to final form and finishes the tip end of the electrode to a mirror surface.

15 Claims, 11 Drawing Sheets

GRINDING MACHINE FOR WELDING ELECTRODES

BACKGROUND OF THE INVENTION

1. Field of the Invention

The present invention relates to improvements in a grinding machine to grind to a specific shape the end portion of welding electrodes of tungsten, molybdenum, chromium and the like for use in such welding techniques as TIG welding and plasma arc welding.

2. Description of the Prior Art

The shape of the end portion of a welding electrode for use in TIG welding is dependent on factors such as electric current density, current distribution and cooling effects etc. in the welding area and affects the efficiency of welding work and the welding quality. Therefore, the end portion of the welding electrode is finished to a proper shape, for example, a sharp cone or two-step cut formed of a tapered area and a flat area (a so-called "truncated conic shape") depending, on the material and thickness of the base metal, welding conditions and other factors. The external surface of the tip of the welding electrode finished to a specific form is polished to a high degree of smoothness. Tungsten electrode A for TIG welding as shown in FIG. 12, for example, has a diameter D of 0.5 to 2.0 mm and tapers to a hemispherical tip $A_0$ with a radius (R) of 0.08 to 0.1 mm. It is desirable that the external surface of the hemispherical tip $A_0$ is more smoothly ground than the tapered section A1 of the electrode. If the external surface of the hemispherical tip $A_0$ is finished to a mirror surface or a specular surface, the directivity and stability of the arc will be substantially improved.

To this end the end portion of the electrode A is usually ground by a special electrode grinding machine. Such as the machine shown in FIG. 13 and disclosed in unexamined Japanese utility model application No. 4-60386 and unexamined Japanese patent application No. 7-276211. The following two methods are widely adopted. In a first method (hereinafter referred to as "the first method"), a grinding disk B1 which has a relatively large grain size (#170, for example) is fixed on motor drive shaft M1 is used to grind the end portion of electrode A to a specific form. Then, the grinding disk B1 is replaced with a grinding disk B2 which has a finer grain size (#500, for example). By use of the grinding disk B2, the tip of the electrode is finely ground. In a second method (hereinafter referred to as "the second method"), two grinding machines are used. One is equipped with grinding disk B1 which has a large grain size and another with grinding disk B2 which has a fine grain size. The end portion of the electrode is shaped to a specific form with the grinding disk B1, and is then finely ground or polished with the grinding disk B2.

In FIG. 13, the letter C indicates a housing, the letter M a grinder motor, the letter D a grinding disk clamping screw, the letter E a dust cover, and the letter F an electrode guide.

However, the problem with the first method is that two grinding disks B1, B2 have to be changed for each stage of the grinding work and therefore the grinding process is inefficient and slow.

The second method requires two electrode grinding machines, which represents poor economy and results in increased maintenance costs.

Furthermore, the axial position of electrode A is often dislocated when grinding disk B1 with a large grain size is replaced with grinding disk B2 with a fine grain size. Accordingly it is difficult to maintain the concentricity of electrode A. As a result, it takes a substantial period of time to grind and polish the tip to a mirror surface and furthermore, the form of the tip itself can change in an unintended way.

PROBLEM THAT THE INVENTION IS TO SOLVE

In view of the problems encountered in grinding the end portion of a welding electrode by grinding machines disclosed in the prior art which are; (1) when working with a grinding machine using a grinding disk with a large grain size and another with a fine grain size, it is troublesome to replace one grinding disk with another each time, and it is difficult to maintain the concentricity of the electrode when the grinding disks are changed, and (2) the use of two grinding machines is expensive and it is difficult to maintain the concentricity of the electrode; it is a general object of the present invention to provide a grinding machine for welding electrodes by which the end portion of even a very short electrode can be ground to a specific shape efficiently by a simple procedure and only the tip is finished to a mirror surface, i.e. all the grinding work can be done by this machine alone, and not using two grinding machines.

SUMMARY OF THE INVENTION

To solve the above-mentioned problems, a particular object of the present invention is to provide a grinding machine for welding electrodes the grinding machine comprising a box-like housing 1, a grinder motor 2 fixed within the housing 1, a disk-like grinding disk 3 fixed on a motor drive shaft 2*a* of a grinder motor 2 and provided with a grinding area 3A, a swing plate 4 provided on the housing 1 above the grinding disk 3 and supported movably in the direction of the axis $\phi$ of a motor drive shaft 2*a*, a cylindrical holder guide 6 tumably supported on the swing plate 4 in a vertical orientation with a downward portion protruding above the grinding disk 3 in the housing 1, an electrode holder 7 removably fitted into holder guide 6 and removably clamping an electrode A with its tip in contact with the grinding area 3A of the grinding disk 3, an electrode turning motor 8 fixed within the housing 1 to turn the holder guide 6 with the electrode holder 7 held therein, and a swing plate moving mechanism 9 for moving the swing plate 4 by a specific distance 1 along the axis $\phi$ of the motor drive shaft 2*a*.

A further object of the invention is to provide a grinding machine as described above wherein the grinding area 3A of the grinding disk 3 is formed of a first grinding part 3*a* made of coarse grains and a second grinding part 3*b* made of fine grains.

According to the invention, the grinding disk exhibits several novel features. The grinding area 3A of the grinding disk 3 is formed of—on a front side of the disk—a first grinding part 3*a* for grinding an end portion of the electrode A to form a cone and—on an outer circumferential side of the disk—a second grinding part 3*b* provided with a V-shaped grinding groove 3*b*' for grinding a tip $A_0$ of the electrode to a mirror surface.

The grinding area 3A of the grinding disk 3 is so constituted that the first grinding part 3*a* for forming the end portion of the electrode A in the form of a cone and the second grinding part 3*b* for polishing the tip $A_0$ of the conically formed end portion of the electrode to a mirror surface are provided on the front side of the disk. The first grinding part 3*a* is on an inner portion of the disk in the radial direction and on the front side thereof in the thickness direction and the second grinding part 3*b* is provided on an outer portion of the disk in the radial direction and on said front side thereof but recessed in the thickness direction. The inclination angle $\alpha_1$ of a longitudinally inclined surface $3a_1$ defining the first grinding part 3*a* is the same as that of a longitudinally inclined surface $3b_1$, defining the second grinding part 3*b*, wherein the inclination angle $\alpha_2$ of a transversely inclined surface $3a_2$ defining the first grinding part 3*a* is the same as that of a transversely inclined surface $3b_2$ defining the second grinding part 3*b*, and the radius R of an arc-like joint between the longitudinally inclined surface $3a_1$ and the transversely inclined surface $3a_2$ of the first grinding part 3*a* is identical to that of an arc-like joint between a longitudinally inclined surface $3b_1$ and a transversely inclined surface $3b_2$ of the second grinding part 3*b*. The grinding area 3A of the grinding disk 3 is integrally formed of grains with a medium grain size.

The grinding area 3A of the grinding disk 3 comprises a longitudinally inclined surface $3a_1$ to form the end portion of the electrode A into the shape of a cone, a transversely inclined surface $3a_2$ to discharge grinding dust and a curved surface $3a_3$ to polish the tip $A_0$ of the electrode A to a mirror surface.

The grinding area 3A of the grinding disk 3 is formed on both sides of a base of the grinding disk 3 symmetrically.

According to one feature of the invention, one end of the swing plate 4 is pivotably fixed on an upper wall of the housing (1) in such a way that the other end can be moved in the direction of the axis $\phi$ of the motor drive shaft 2*a*.

According to a further feature of the invention, the electrode holder 7 comprises a cylindrical chuck guide 7*a*, a collet chuck 7*b* to be inserted into an end of the chuck guide and a cylindrical chuck screw 7*c* inserted into the chuck guide 7*a* from an upper side thereof, with the tip portion screwed into the collet chuck 7*b*. A spacer 16 with a specific thickness h may be placed on the chuck guide 7*a* so that the tip $A_0$ of the electrode A is positioned within a grinding groove 3*b*' of the second grinding part 3*b*.

Another object of the invention is to provide a grinding machine as described above wherein the holder guide 6 with the electrode holder 7 held therein is turned by the electrode turning motor 8 via a round rubber belt 15.

A further object of the invention is to provide a grinding machine for welding electrodes as described above wherein the swing plate moving mechanism 9 comprises a moving handle 9*a* and a worm gear 9*b* which is turned by the moving handle and engages with a thread 4*c* provided on the swing plate 4.

Another object of the invention is to provide a grinding machine as described above wherein the distance for which the electrode holder 7 is moved by the swing plate moving mechanism 9 is indicated by a dial gauge 10 having a drive body 10*a* which is interlocked with a gauge stopper 4*b* provided on the swing plate 4.

LIST OF NUMERALS

Figure 1:
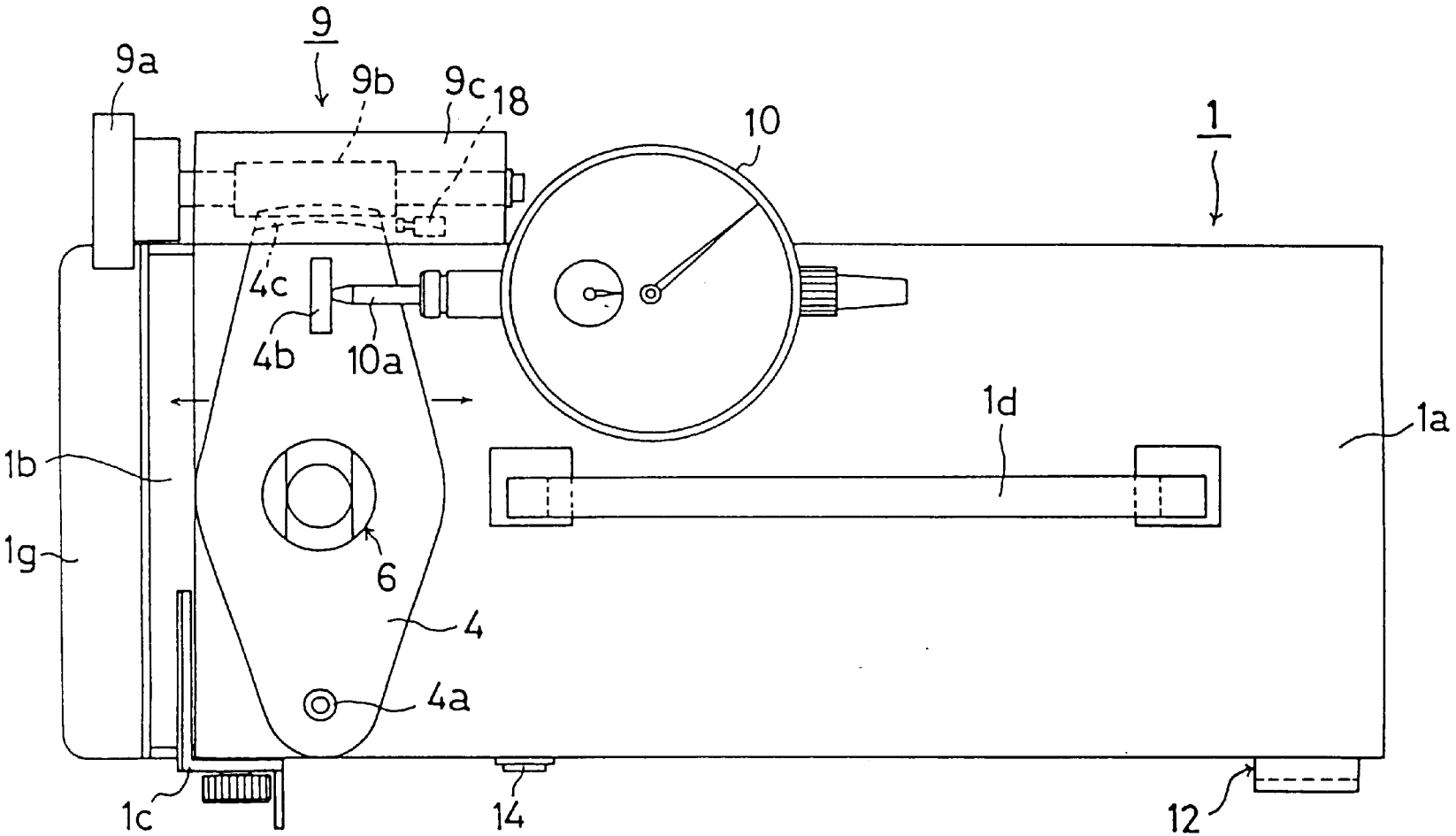
FIG. 1 is a plan view of a grinding machine for welding electrodes in accordance with the present invention.

A electrode A
$\phi$ axis of motor drive shaft
$\phi_a$ electrode axis
$A_1$ tapered section of electrode
$A_0$ tip end of electrode
1*a* case main body
1*b* dust cover
1*c* clamp
1*d* grip
1*e* bushing
1*f* partition plate
1*g* dust case
1*h* support component part
1*i* hole
1*j* storage port
2 grinder motor
2*a* drive shaft
2*b* grinding disk holder
3 grinding disk
3A grinding area
3*a* first grinding part
3*b* second grinding part
$3a_1$ longitudinally inclined surface
$3b_1$ longitudinally inclined surface
$3a_2$ transversely inclined surface
$3b_2$ transversely inclined surface
3*b*' grinding groove
3*c* base
4 swing plate
4*a* support axis
4*b* gauge stopper
4*c* screw
4*d* bushing fixing hole
5 cylindrical bushing
6 holder guide
6*a* annulus
6*b* pulley
7 electrode holder
7*a* chuck guide
7*b* collet chuck
7*c* check screw
8 electrode turning motor
8*a* drive shaft
9 swing plate moving mechanism
9*a* moving handle
9*b* worm gear

9*c* worm box
10 dial gauge
10*a* drive body
11 electric control unit
12 grinding extent setting gauge
12*a* gauge main body
12*b* nut
12*c* setting bolt
13 grinding disk clamping screw
14 switch for grinder motors
15 round rubber belt
16 spacer
17 drive pulley
18 switchover limit switch

DESCRIPTION OF THE PREFERRED EMBODIMENTS

Now, the embodiments of the present invention will be described with reference to the drawings.

Figure 2:
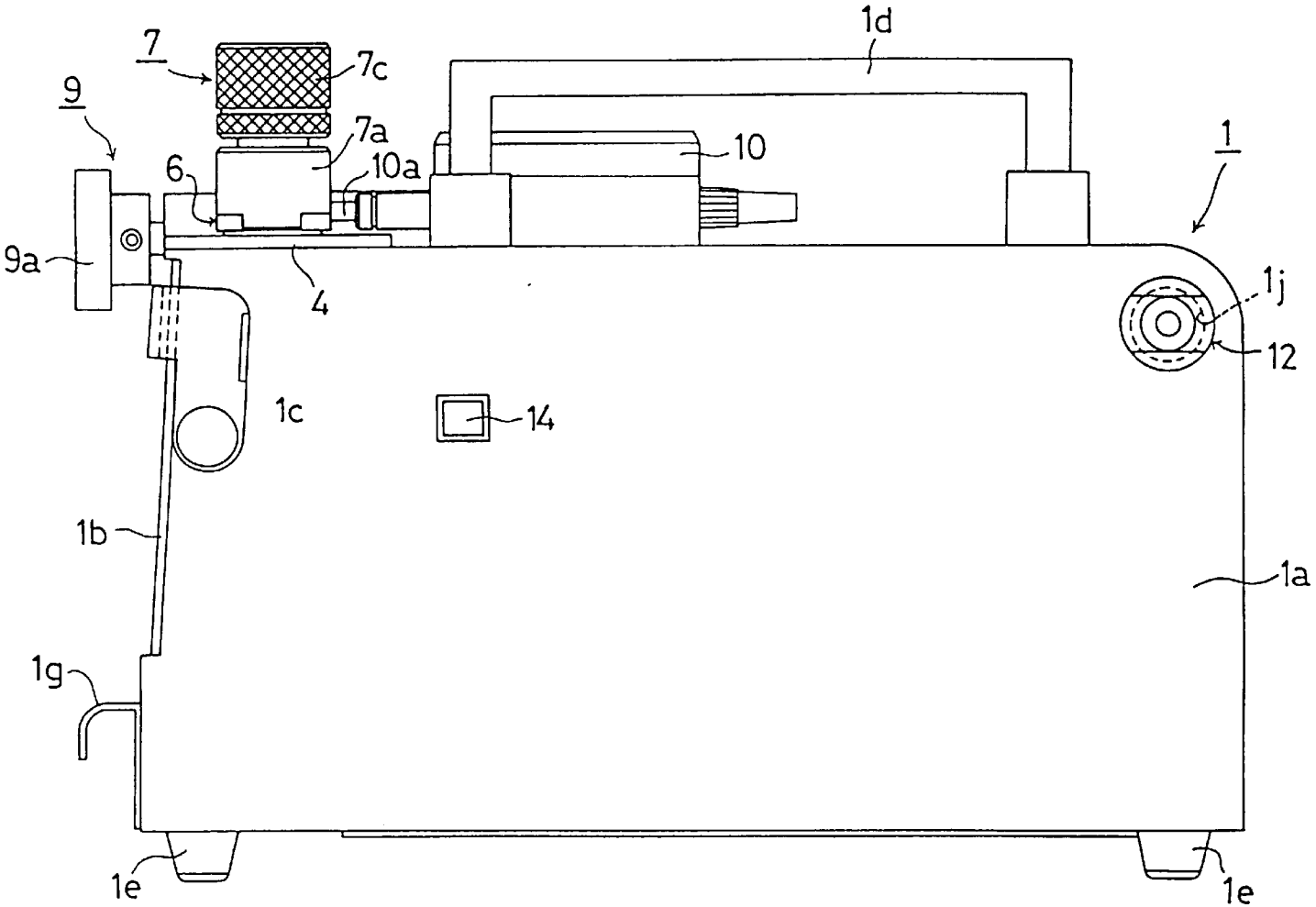
FIG. 2 is a side elevation of the grinding machine for welding electrodes.
Figure 3:
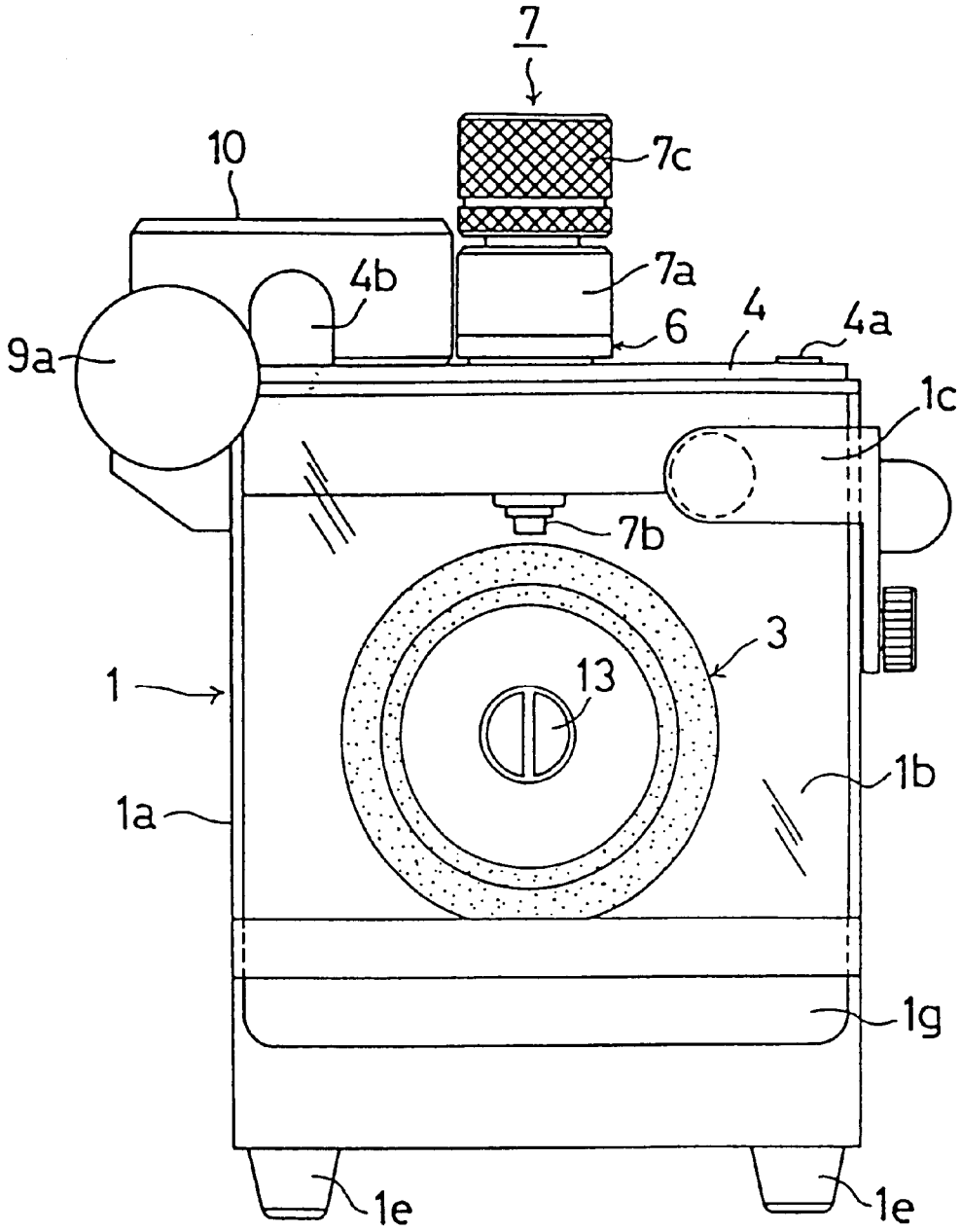
FIG. 3 is a front elevation of the grinding machine for welding electrodes.
Figure 4:
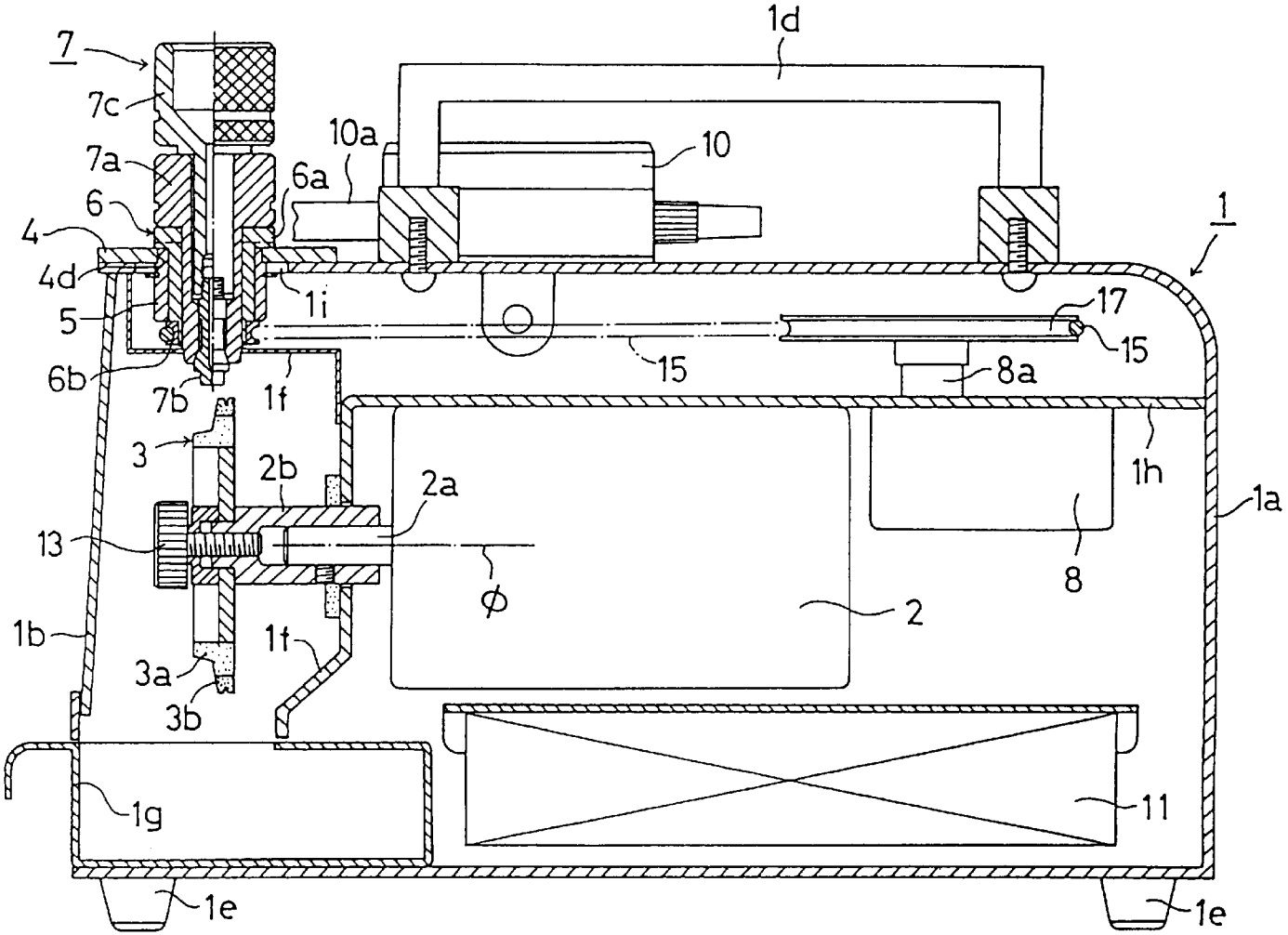
FIG. 4 is a vertical, sectional side elevation of the essential part of the grinding machine for welding electrodes.
Figure 5:
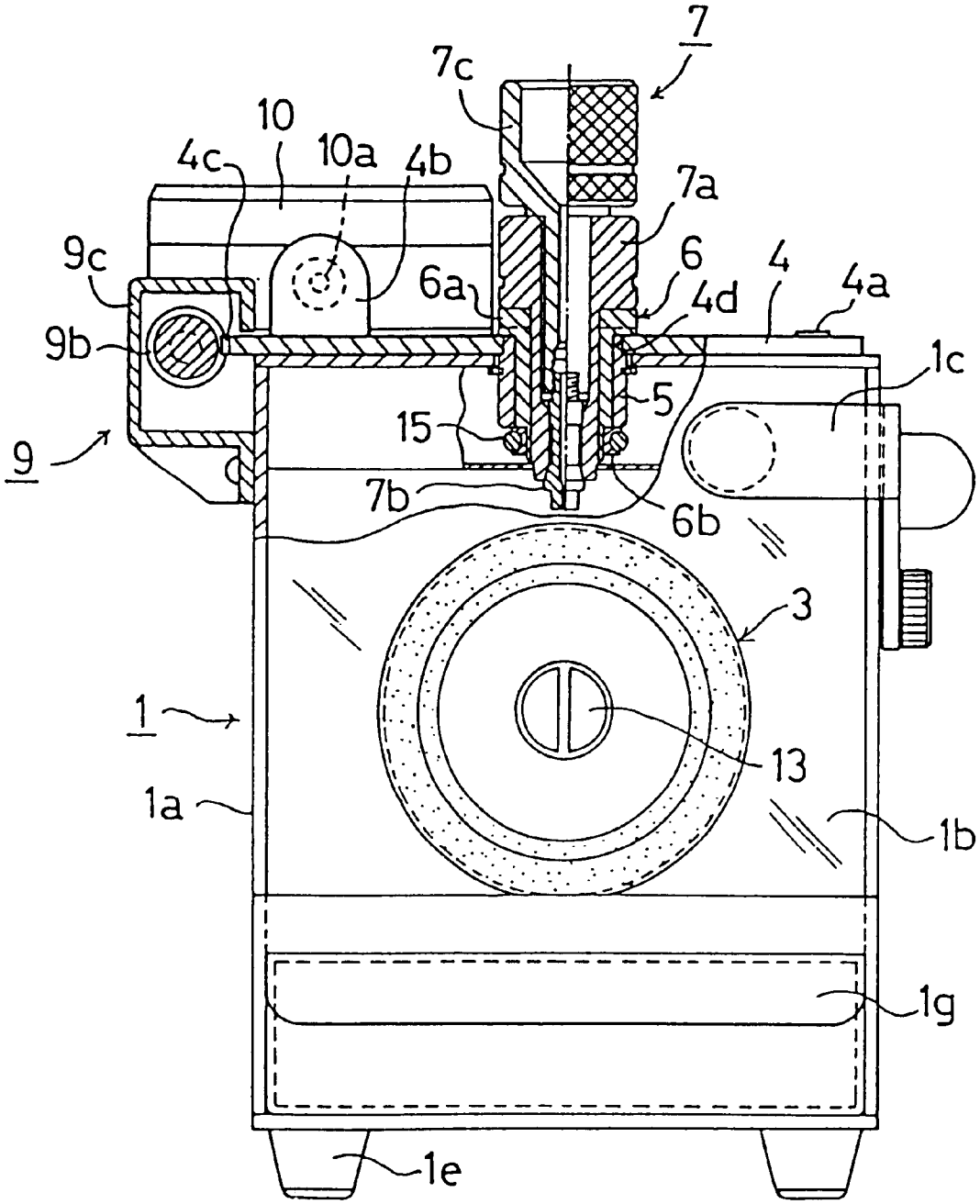
FIG. 5 is a vertical, sectional front elevation of the essential part of the grinding machine for welding electrodes.

FIG. 1 is a plan view of a grinding machine for welding electrodes of the present invention. FIG. 2 is a side elevation thereof. FIG. 3 is a front elevation thereof. FIG. 4 is a schematic vertical, sectional elevation thereof. FIG. 5 is a schematic vertical front elevation.

The grinding machine for welding electrodes of the present invention comprises a box-shaped housing 1, a grinder motor 2 placed inside the housing 1, a grinding disk 3 which is turned at a high speed by the grinder motor 2, a swing plate 4 provided in a front part of an upper wall of the housing 1, a cylindrical bushing 5 fixed vertically in the centre of the swing plate 4, a cylindrical holder guide 6 rotatably inserted into the bushing 5, an electrode holder 7 removably inserted into the holder guide 6 in a vertical position, an electrode turning motor 8 for turning the electrode holder 7 via holder guide 6, a swing plate moving mechanism 9 to move one side of the swing plate 4 supporting the electrode holder 7, a dial gauge 10 to indicate the extent of movement of the electrode holder 7 held by the swing plate 4, and an electric control unit 11 to control the drive of the grinder motor 2 and electrode turning motor 8, etc. In addition, the housing 1 is provided with a grinding extent setting gauge 12 to set the extent of grinding the electrode, a dresser (not shown) to clean the grinding surface of the grinding disk 3 and others.

The housing 1 is made in the form of a box and is formed of a housing main body 1*a* made of steel plate or a plastic material with an opening on a front side and a dust cover 1*b* made of a transparent plastic material that covers the opening of the front side. In addition, the housing 1 includes a clamp 1*c* to fix the dust cover 1*b*, a grip Id and bushings 1*e*.

The interior of housing main body 1*a* is partitioned by a partition plate 1*f*. A dust case 1*g* is removably placed in a lower part of a front compartment.

Furthermore, a support member 1*h* for fixing the motors 2, 8 is provided in the rear compartment of the housing main body 1*a*.

In the centre of the upper wall of the front compartment of the housing main body 1*a*, there is provided a hole 1*i* with a long opening into which are inserted the cylindrical bushing 5, the holder guide 6 etc. as will be described below. Furthermore, a port 1*j* to store a grinding extent setting gauge 12 is provided in a one side of the rear compartment.

The grinder motor 2 is fixed horizontally on a lower side of the support member 1*h* with a motor drive shaft 2*a* extending through the partition plate 1*f* and protruding up into a space above the dust case 1*g* of the housing main body 1*a*.

In addition, a grinding disk holder 2*b* is fixed on the motor drive shaft 2*a*. Furthermore, the grinding disk 3 is removably clamped on the grinding disk holder 2*b* by a grinding disk clamping screw 13.

The grinder motor 2 used in this embodiment is a 100-watt single phase alternating current motor for 100 volts, AC, 50/60 Hz. If a switch 14 for grinder motors is turned on, the motor will turn for a specific time preset by a electric control unit 11 and will be automatically stopped by a timer switch.

Embodiment 1 of the Grinding Disk

Figure 6:
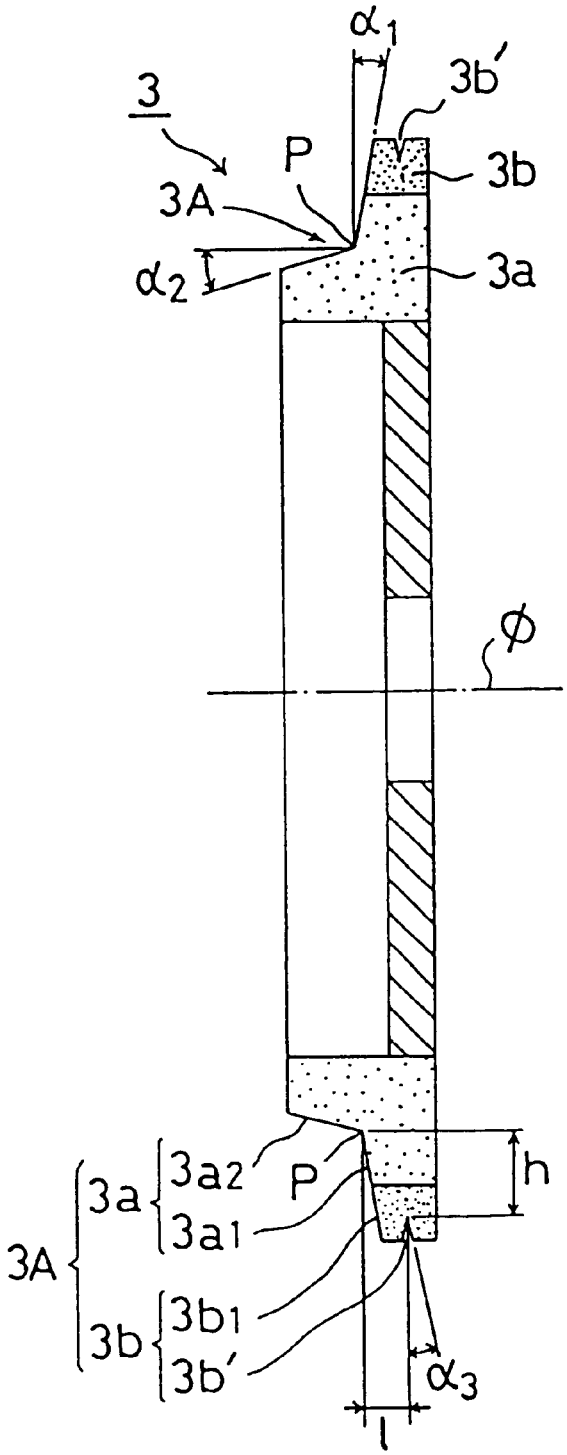
FIG. 6 is a sectional view of a grinding disk.

The grinding disk 3 is made in the form of a disk approximately 60 mm in diameter and about 8.2 mm in thickness as shown in FIG. 6. The grinding disk 3 is fitted over a stepped front end of the grinding disk holder 2*b* and fixed by said grinding disk clamping screw 13.

The grinding disk 3 is formed of a first grinding part 3*a* made of relatively coarse diamond abrasive grains and a second grinding part 3*b* made of relatively fine diamond abrasive grains. The first grinding part 3*a* has a longitudinally inclined surface $3a_1$ with an inclination having an angle $\alpha_1$ of approximately 10° with respect to a line perpendicular to the axis $\phi$ of the motor drive shaft 2*a* and a transversely inclined surface $3a_2$ with an inclination angle $\alpha_2$ of approximately 20° with respect to said axis $\phi$. The intersection point P of the two surfaces is curved with a radius of about 0.08 mm.

The second grinding part 3*b* of the grinding disk 3 is formed on an outer circumferential surface of the first grinding part 3*a* and has a longitudinally inclined surface $3b_1$ continuous with the longitudinally inclined surface $3a_1$ of the first grinding part 3*a*. On the outer circumferential surface of the second grinding part 3*b*, there is provided a V-shaped grinding groove 3*b*' with an opening angle $\alpha_3$ of approximately 10° with a line perpendicular to the axis $\phi$ and a depth of about 1.2 mm.

In the present embodiment, the first grinding part 3*a* is formed of relatively coarse diamond abrasive grains about #170 in grain size, and the second grinding part 3*b* is formed of relatively fine diamond abrasive grains about #500 in grain size.

Furthermore, the shortest distance 1 between the line passing the intersection point P, perpendicular to the axis $\phi$ and the centre of the grinding groove 3*b*' is set at about 2.5 mm and the shortest distance h between the line passing the intersection point P, parallel to the axis $\phi$ and the bottom of the grinding groove 3*b*' is set at about 3.8 mm (for an electrode A 2.0 mm in outside diameter).

Referring to FIGS. 1 to 5, the swing plate 4 is provided on the front end of the upper side of the housing main body 1*a* and one end thereof is pivotably held at one point by a support axis 4*a* so that the swing plate 4 can move in the directions of the arrows as shown in FIG. 1.

Another end of the swing plate 4 has a gauge stopper 4*b* thereon which is brought into contact with the tip of a drive body 10*a* of the dial gauge 10.

Furthermore, the other end of the swing plate 4 has a screw thread 4*c* that engages with a worm gear 9*b* of the swing plate moving mechanism 9, which will be described below.

A bushing fixing hole 4*d* is formed in the centre of the swing plate 4. In this bushing fixing hole 4*d*, a short cylindrical bushing 5 is inserted to support rotatably said electrode holder 7. And the top of the cylindrical bushing 5 is fixed to the swing plate 4.

In the short cylindrical bushing 5, the cylindrical holder guide 6 is rotatably inserted from above. That is, the holder guide 6 is turnably and movably supported in a vertical position with an annulus 6*a* at the top engaging with an upper end surface of the bushing 5.

The holder guide 6 is to fix removably the electrode holder 7 and is cylindrical in shape as shown in FIG. 4. Said holder guide 6 is rotatably supported in a vertical position on the swing plate 4 via the bushing 5 as mentioned above, and in this holder guide 6, the electrode holder 7 is removably inserted and fixed.

In addition, a slave pulley 6*b* is formed in a lower part of the holder guide 6. A rubber belt 15 connects the slave pulley 6*b* and a drive pulley 17 disposed on a drive shaft 8*a* of the electrode turning motor 8.

The electrode holder 7 is to hold removably and clamp an electrode A in such a way that a tip of the electrode is in contact with the first grinding part 3*a* of the grinding disk 3.

Figure 7:
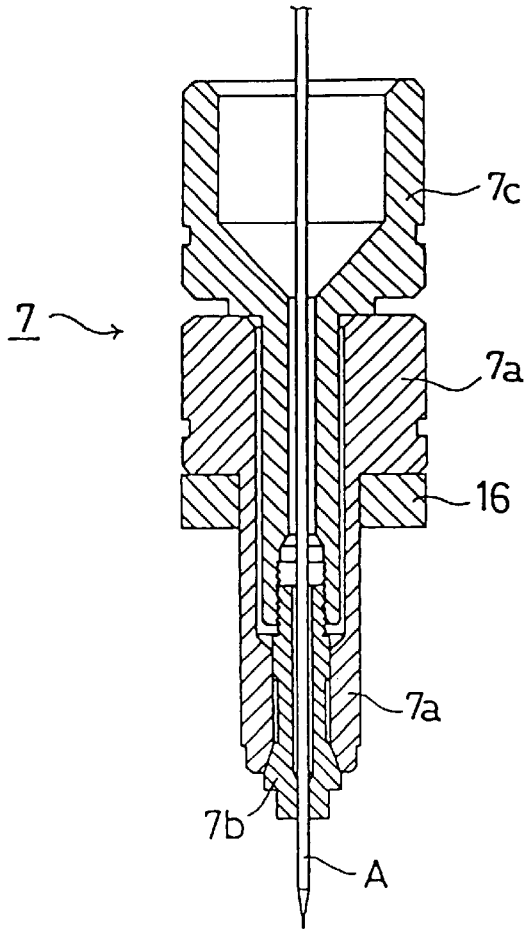
FIG. 7 is a sectional view of an electrode chuck body.

The electrode chuck unit 7 comprises, as shown in FIG. 7, a cylindrical chuck guide 7*a* to be removably inserted into the holder guide 6, a collet chuck 7*b* inserted into an end portion of the chuck guide 7*a* and a chuck screw 7*c* inserted from an upper side of the chuck guide 7*a* and screwed on and engaged with the collet chuck 7*b*. If the electrode A is passed through the collet chuck 7*b* and the chuck screw 7*c* is tightened up, the collet chuck 7*b* will squeeze and hold and clamp the electrode A.

A number of different collet chucks 7*b* can be made with different respective inside diameters of electrode insertion hole. In the present embodiment, by electing a collet chuck with an appropriate diameter of electrode insertion hole, the grinding machine can accept electrodes A with diameters between 1.0 mm to 2.6 mm.

In addition, the chuck guide 7*a* is so made that a spacer 16 can be removably fitted on the chuck guide 7*a* as shown in FIG. 7. As will be described below, the spacer 16 is used when the tip $A_0$ of electrode A is ground to a mirror surface by the second grinding part 3*b* after an end portion of electrode A is formed.

The electrode turning motor 8 is mounted in a rear portion within the housing main body 1*a* and is put on a lower side of the support member 1*h*.

Said drive pulley 17 is fixed on said drive shaft 8*a* of the electrode turning motor 8. And an endless rubber belt 15 is placed around the drive pulley 17 and the slave pulley 6*b* of the holder guide 6. Thus, if the electrode turning motor 8 is turned, the holder guide 6 is driven via said endless rubber belt 15, which, in turn, drives the electrode holder 7 removably clamped in the holder guide 6 and the electrode A fixed therein.

The swing plate moving mechanism 9 comprises a moving handle 9*a*, the worm gear 9*b* to be turned by said moving handle 9*a*, and the thread 4*c* at the end of the swing plate 4 engaging said worm gear 9*b* and others. If the moving handle 9*a* is turned, the worm gear 9*b* moves the swing plate 4 in the directions of the arrows using the support axis 4*a* as a fulcrum.

If the swing plate 4 moves in the directions of the arrows, the electrode holder 7 fixed on the swing plate 4 moves together with the result that the tip of electrode A moves in the direction of the axis $\phi$ of the motor drive shaft 2*a*.

The extent to which the swing plate 4 is moved by turning the moving handle 9*a* is shown on the dial gauge 10. That is, as said drive body 10*a* that is in contact with the gauge stopper 4*b* on the swing plate 4 moves in the directions of the arrows, the extent of movement of the swing plate 4 is indicated on the dial gauge 10.

It is noted that the dial gauge 10 itself is known and will not be explained.

The electric control unit 11 is for controlling the operation, including startup and stopping of the grinder motor 2 and the electrode turning motor 8. If the switch 14 for grinder motor is turned on, the two motors 2, 8 will turn at a specific speed for a preset time.

To grind and polish the tip of electrode A to a mirror surface using the second grinding part 3*b* of the grinding disk 3, the two motors 2, 8 are switched to high speed mode with a greater number of revolutions by actuating a switchover limit switch 18, and the two motors 2, 8 turn at a specific speed for a preset time.

Said grinding extent setting gauge 12 is used to set the protruding extent of the electrode A held by the electrode holder 7 to decide the grinding extent of electrode A. The grinding extent setting gauge 12 is removably stored on one side wall of the housing main body 1*a*.

Figure 8:
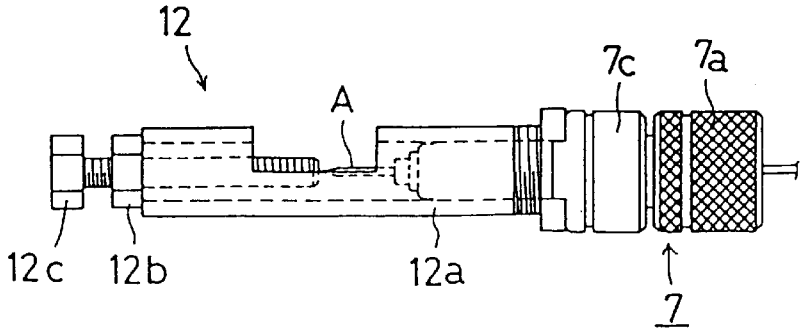
FIG. 8 is an explanatory view of an electrode grinding extent setting gauge.

The grinding extent setting gauge 12 comprises, as shown in FIG. 8, a cylindrical gauge main body 12*a*, a nut 12*b* fixed on an end of the gauge main body 12*a* and a setting bolt 12*c* screwed into the nut 12*b*. With the electrode holder 7 inserted into the gauge main body 12*a*, the tip of electrode A is brought into contact with the setting bolt 12*c* which controls the extent to which the electrode A protrudes out of the electrode holder 7.

In this regard, the grinding extent setting gauge 12 is used in the following way. First, the electrode A is held and clamped in the electrode holder 7 with its tip portion protruding by a specific length. Then, the electrode holder 7 is inserted into the holder guide 6 and the electrode A is test-ground on the first grinding part 3*a* of the grinding disk 3. Then the electrode is checked to see if the end portion is ground to a perfect cone. If electrode A is ground perfectly, the electrode holder 7 with electrode A held and clamped thereon is taken out and placed in the gauge main body 12*a*, and the setting bolt 12*c* is moved to adjust the gap between the tip of the electrode A and the end of the setting bolt 12*c* to a specific distance, 0.5 mm, for example. Once the grinding extent setting gauge is set this way, the grinding extent of the electrode A can be adjusted and fixed simply by this gauge.

Next, the grinding of an electrode A using the grinding machine for electrodes of the present invention will be described.

The first step is to select a grinding disk 3 that is suitable for electrode A with regard to its diameter and the grinding shape of the end portion. This grinding disk 3 is placed on the motor drive shaft 2*a*. Then, the electrode A is inserted into the collet chuck 7*b* of the electrode holder 7. With its tip portion protruded by a specific length (45 mm to 50 mm) from the end of the collet chuck 7*b*, the electrode A is slidably held by lightly tightening the chuck screw 7*c*.

The electrode holder 7 with said electrode A held therein is inserted into the gauge main body 12*a* of the grinding extent setting gauge 12 and, with the tip of the electrode A in contact with the setting bolt 12*c*, the electrode A is pushed back though the collet chuck 7*b*. And when the electrode holder 7 is fully fitted into the gauge main body 12*a*, the chuck screw 7*c* is tightened up to clamp the electrode A. Thus, the protruding extent and the grinding extent of electrode A are now set. It is assumed that the electrode A has been test-ground as mentioned above and that the position of the setting bolt 12*c* of the grinding extent setting gauge 12 has been adjusted properly.

Then, the electrode holder 7 is inserted into the holder guide 6 to place the tip of the electrode A on the first grinding part 3*a* of the grinding disk 3, and then the switch 14 is turned on.

While the electrode A turns, its tip is kept in contact with the first grinding part 3*a* of the grinding disk 3 and gradually ground. As the electrode A is ground, the electrode holder 7 slides down through the holder guide 6 under its own weight, and the end portion of electrode A is automatically ground in the form of a cone. When the electrode holder 7 slides down by a certain distance, a knob of the chuck guide 7*a* comes to rest on an upper end of the holder guide 6, preventing the electrode holder 7 from sliding down any further.

When the electrode A is ground for a specific time, the timer automatically switches off the motors 2, 8 with the conical form grinding completed. When the electrode A has been ground to a conical shape the electrode holder 7 is pulled out of the holder guide 6 and the spacer 16 is put on the electrode holder 7.

Then, while watching the dial gauge 10, the moving handle 9*a* of the swing plate moving mechanism 9 is turned to move the position of the axis of the holder guide 6 inwardly (i.e. in the direction of the centre of the housing 1) by a specific distance 1. Thus, the tip of electrode A held by the electrode holder 7 comes just above the second grinding part 3*b* of the grinding disk 3 when the electrode holder 7 is placed in the holder guide 6.

After the swing plate 4 is moved to its new position, the spacer 16 is put on the chuck guide 7*a* of the electrode holder 7. And the electrode holder 7 with the spacer 16 put thereon is placed in the holder guide 6.

The thickness of the spacer 16 is set to dimension h mentioned above. Thus, the tip of cone shaped electrode A held in the electrode holder 7 contacts the V-shaped grinding groove 3*b*' of the second grinding part 3*b*.

If the switch 14 for the grinder motor is now turned on again, the grinding disk 3 and the holder guide 6 turn at a specific high speed for a specific time, and the electrode holder 7 moves down some 1.2 mm under its own weight. As a result, a spherical portion of the tip of electrode A is ground to a mirror surface by the fine-grained second grinding part 3*b*.

It is noted that when the swing plate 4 is moved, the switchover limit switch 18 is actuated to automatically switch the two motors 2, 8 to a high speed. And the hemispherical tip of the electrode A is finished to a mirror surface with great efficiency.

Embodiment 2 of the Grinding Disk

Figure 9:
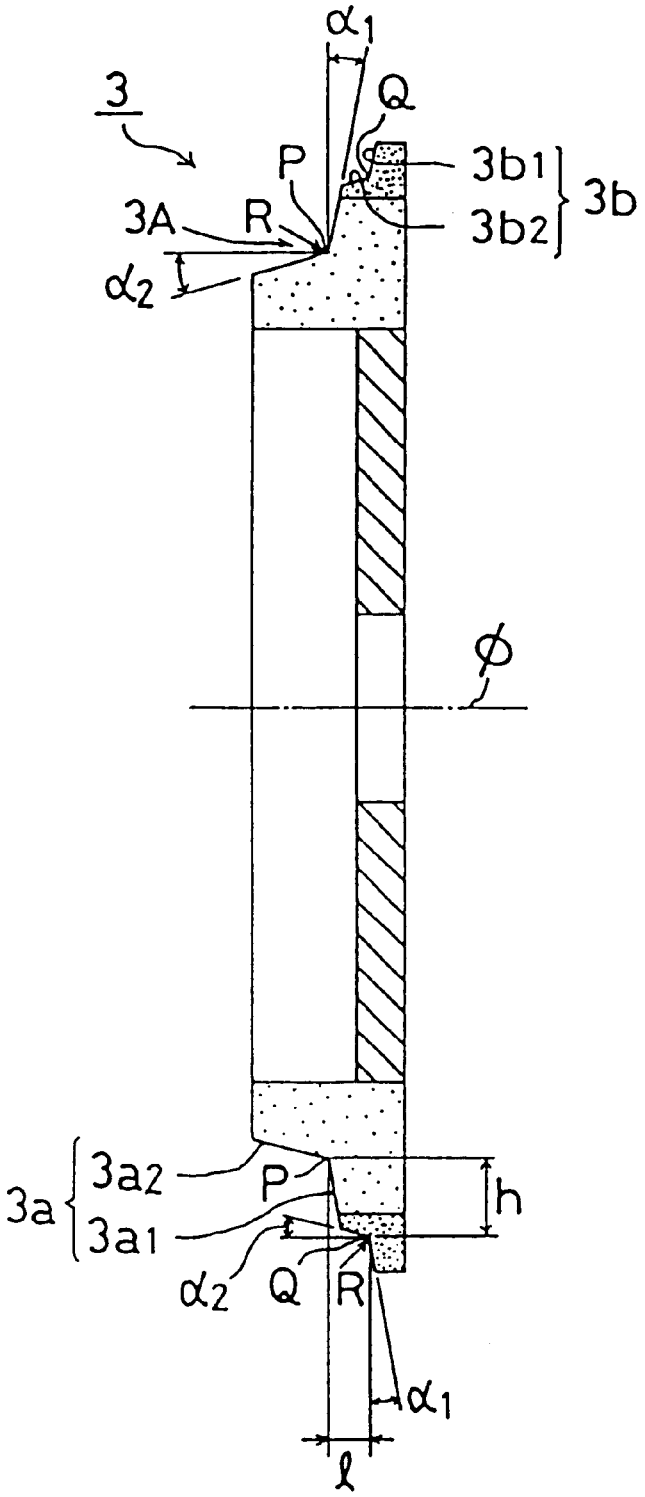
FIG. 9 is a sectional view of a grinding disk for welding electrodes in accordance with a second embodiment.

FIG. 9 shows a second embodiment of the grinding disk 3. As with the grinding disk 3 of the first embodiment the grinding disk 3 of the second embodiment is made in the form of a disk about 60 mm in diameter and about 8.2 mm in thickness. The grinding disk 3 is placed on the stepped part of the front end portion of the grinding disk holder 2*b* and clamped to the grinding disk holder 2*b* by tightening up the clamping screw 13.

As is shown in FIG. 9, the grinding disk 3 has a first grinding part 3*a* made of relative coarse grains of about #170 and a second grinding part 3*b* made of relatively fine grains of about #500. The first grinding part 3*a* and the second grinding part 3*b* are formed as step formations on the front side of the disk.

That is, the first grinding part 3*a* is provided on the front side of the disk in an inner portion in the radial direction. The first grinding part 3*a* has a longitudinally inclined surface $3a_1$ having an inclination with an angle $\alpha_1$ of approximately 10° with respect to a line perpendicular to the axis $\phi$ of the motor drive shaft 2*a*, and a transversely inclined surface $3a_2$ having an inclination angle $\alpha_2$ of approximately 20° with respect to the axis $\phi$. A joint P between the two inclined surfaces is curved in the form of an arc with a radius R of approximately 0.08 mm.

The second grinding part 3*b* is provided outside the first grinding part 3*a* in the radial direction and on the front side but recessed in the thickness direction, and has a longitudinally inclined surface $3b_1$ having an inclination angle $\alpha_1$ of approximately 10° with the line perpendicular to the axis $\phi$ of the motor drive shaft 2*a* and a transversely inclined surface $3b_2$ having an inclination with an angle $\alpha_1$ of approximately 20° with respect to the axis $\phi$. An arc-shaped joint Q between the two inclined surfaces is curved with a radius R of approximately 0.08 mm.

The distance 1 in the thickness direction of the disk (that is, the drive shaft direction of the grinder motor) is about 2.5 mm between the arc-like joint P of the first grinding part 3*a* and the arc-like joint Q of the second grinding part 3*b*, and the distance h in the radial direction of the disk is set at some 3.8 mm (for electrode A with an outside diameter of 2.0 mm).

In the second embodiment, the first grinding part 3*a* and the second grinding part 3*b* are identical in terms of their angles $\alpha_1$, $\alpha_2$ and radius R. Needless to say, they may be made different from each other.

Also, this second embodiment is identical to the first embodiment in terms of distance 1 and distance h. Again, needless to say, a different distance 1 and a different distance h may be adopted in the second embodiment.

The procedure of grinding the electrode A using the grinding disk 3 in the second embodiment is exactly the same as that in the first embodiment and will not be explained.

In the grinding disk 3 of the second embodiment, the second grinding part 3*b* is open on the front side, and does not have a V-shaped groove as in the first embodiment. Therefore, the second grinding part 3*b* is hardly clogged. That substantially saves labour needed for maintenance and care of the grinding disk 3.

Embodiment 3 of the Grinding Disk

Figure 10:
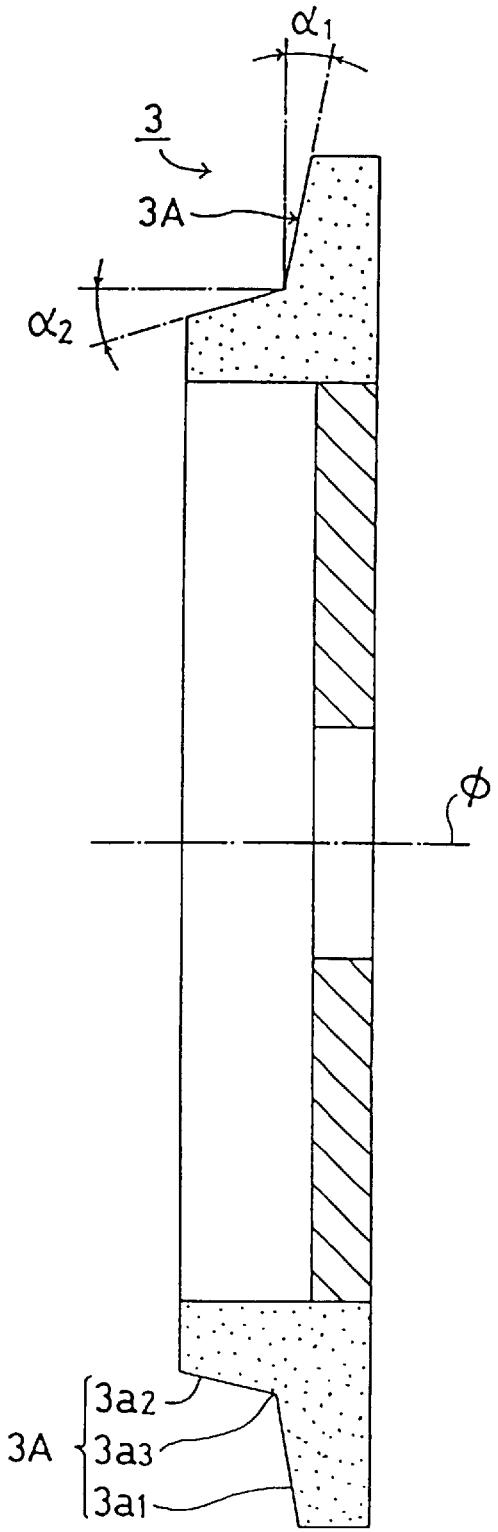
FIG. 10 is a sectional view of a grinding disk for welding electrodes according to a third embodiment.

FIG. 10 shows a third embodiment of the grinding disk 3. As shown in FIG. 10, the grinding disk 3 is some 60 mm in diameter and about 8.2 mm in thickness and is integrally formed of diamond abrasive grains (abrasive material) of a medium grain size (#350, for example) between coarse grains (#170, for example) and fine grains (#500, for example). The grinding disk 3 is put on the stepped part of the grinding disk holder 2*b* and clamped by the grinding disk clamping screw 13.

Figure 12:
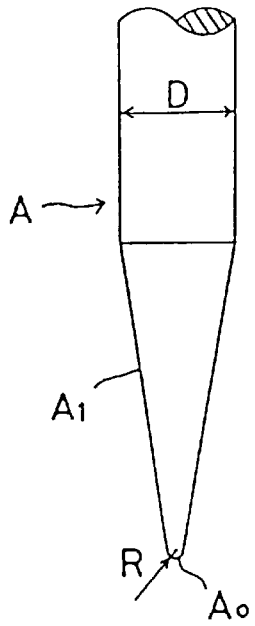
FIG. 12 PRIOR ART
FIG. 12 shows an example of the form of the end portion of a tungsten electrode for TIG welding.
Figure 13:
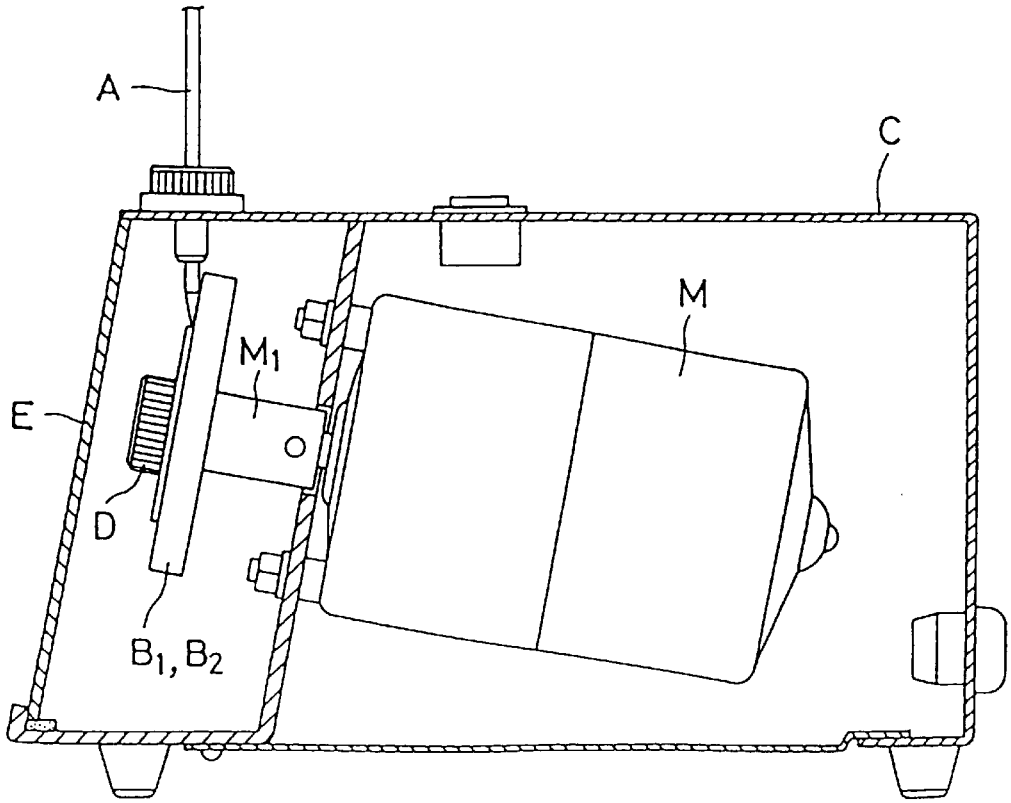
FIG. 13 PRIOR ART
FIG. 13 shows an example of the prior art grinding machine for welding electrodes.

The grinding disk 3 is provided with a grinding area 3A to grind the end portion of the electrode A. Said grinding area 3A is formed in a shape corresponding to the finished shape of the end portion of the electrode A as shown in FIG. 12.

That is, the grinding area 3A is defined by a longitudinally inclined surface $3a_1$ having an inclination angle $\alpha_1$ of approximately 10° with respect to the line perpendicular to the axis $\phi$ of the motor drive shaft 2*a* that grinds the end portion of the electrode A into the shape of a cone, a transversely inclined surface $3a_2$ having an inclination angle $\alpha_2$ of approximately 20° with respect to the axis $\phi$ of the motor drive shaft 2*a* that serves to discharge grinding dust, etc., and a curved surface 3*a*$_3$ or an arc-like joint between the two inclined surfaces with a radius R of approximately 0.08 mm that grinds the tip $A_0$ of a tapered section A1 of the electrode A into a hemispherical mirror surface (for electrode A with an outside diameter D=2.0 mm).

To grind the electrode A, the electrode holder 7 is inserted into the holder guide 6 and, with the tip of electrode A in contact with the grinding area 3A of the first grinding part 3*a*, the switch for the grinder motor 14 is turned on, as in the case of the first embodiment.

Then, the grinding disk 3 is turned about the axis $\phi$ by the grinder motor 2, and at the same time the electrode A is turned around the axis $\phi_a$ by the electrode turning motor 8.

In this way, the electrode A turns and the end portion thereof is ground on the grinding area 3A of the grinding disk 3 with which the electrode A is in contact. As the electrode A is ground, the electrode holder 7 moves down in the holder guide 6 under its own weight. And the end portion of the electrode A is automatically shaped to a cone by the longitudinally inclined surface 3*a*$_1$ of the grinding disk 3. At the same time, the tip of the electrode A is ground and finished to a hemispherical mirror surface by the curved surface 3*a*$_3$ of the grinding disk 3.

The reason why the electrode A is ground and finished that way is as follows. It is so arranged that the axis $\phi_a$ of the electrode A extends along a line perpendicular to the axis $\phi$ of the motor drive shaft 2*a*, and the grinding area 3A of the grinding disk 3 has a form corresponding to the finished shape of the electrode A. Furthermore, the grinding disk 3 is turned by the grinder motor 2, and at the same time the electrode A is turned by the electrode turning motor 8.

When the electrode holder 7 has moved down by a specific distance, the knob of the chuck guide 7*a* comes into contact with the top end of the holder guide 6 and hence electrode holder 7 is prevented from moving down any further.

When the grinding continues for a certain time, the timer switch automatically stops the motors 2, 8, and the grinding is finished. The electrode holder 7 is pulled out of the holder guide 6, and electrode A is taken out of the electrode holder 7. Then electrode A is obtained with the end section in the form of a conic taper $A_1$ and with the tip end $A_0$ finished to a hemispherical, mirror surface as shown in FIG. 12.

To grind an electrode A with a different outside diameter or to adjust the grinding extent, the moving handle 9*a* of the swing plate moving mechanism 9 is turned to move the position of the axis of the holder guide 6 along the axis $\phi$ of the motor drive shaft 2*a* by a specific distance while watching the dial gauge 10 so as to adjust the contact between the electrode A and the grinding disk 3.

In the preceding example, the grinding area 3A of the grinding disk 3 is provided with a longitudinally inclined surface 3*a*$_1$, and the curved surface 3*a*$_3$ is matched to the finished shape of the electrode A as shown in FIG. 12. The present invention is not limited to that. To obtain an electrode A with an end portion having two tapered sections with different angles, that is, a two-step conical form, the grinding area 3A may be provided with a two-stepped inclination contour, that is, two longitudinally inclined surfaces.

Embodiment 4 of the Grinding Disk

Figure 11:
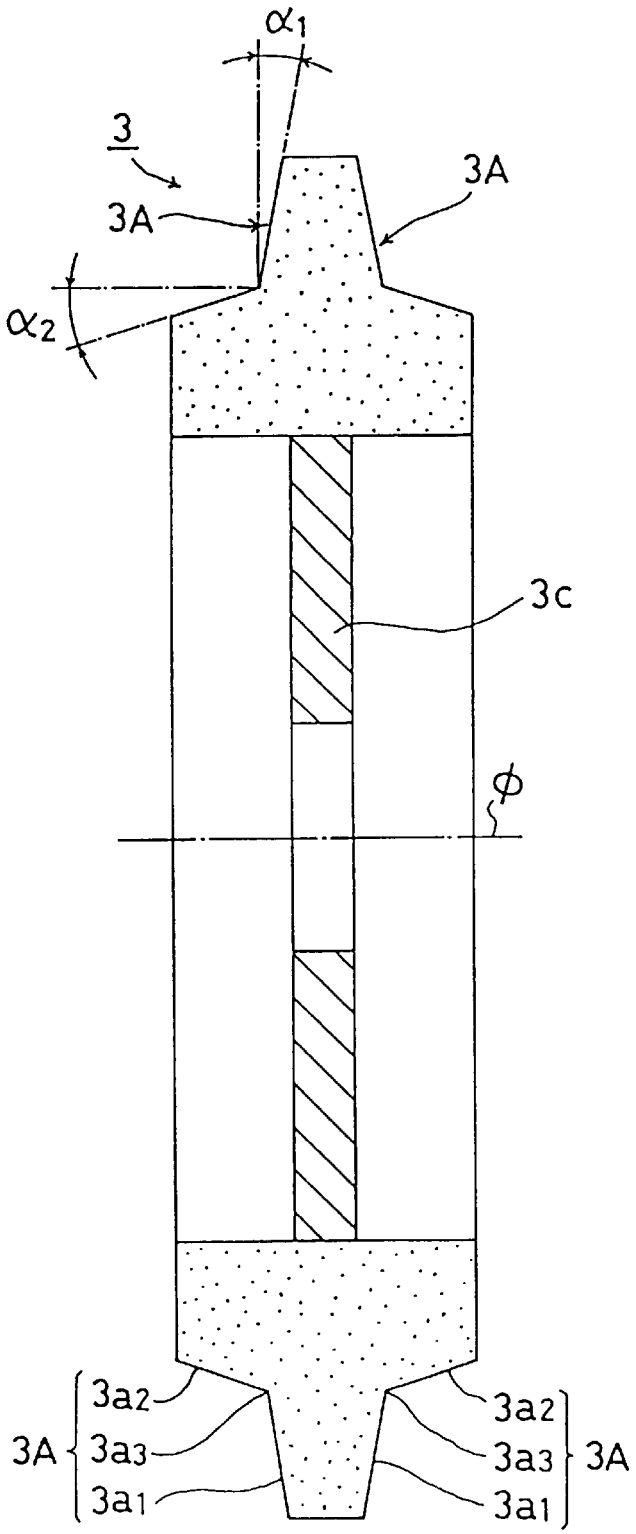
FIG. 11 is a sectional view of a grinding disk for welding electrodes according to a fourth embodiment.

FIG. 11 shows a fourth embodiment of the grinding disk 3. This grinding disk 3 has two grinding areas 3A of the third embodiment symmetrically formed on both sides of a base 3*c* so that each of the two grinding areas 3A can be used in turn.

The procedure of grinding by this grinding disk 3 is the same as that by the grinding disk 3 of the third embodiment and will not be repeated.

Effects of the Invention a. In the present invention, it is so arranged that the axis of the electrode extends along a line perpendicular to the axis of the motor drive shaft and that the grinding part of the grinding disk is so formed to conform to the finished shape of the electrode. Furthermore, when the grinding disk is turned by the grinder motor, the electrode is turned by the electrode-turning motor at the same time. Therefore, using one grinding disk and one grinding machine for electrodes, it is possible to shape the end portion of an electrode to a final form and finish the tip to a mirror surface.

b. In the present invention, there is provided a two-part grinding disk 3 comprising a first grinding part 3*a* formed of coarse grains with a large grain size and a second grinding part 3*b* formed of fine grains with a fine grain size. And it is so arranged that the swing plate 4 turnably supporting the electrode holder 7 is moved by the swing plate moving mechanism 9, and an end portion of the electrode A is ground by the first grinding part 3*a* and the second grinding part 3*b*.

By this arrangement, the end portion of the electrode is conically shaped by the first grinding part 3*a* with relatively large abrasive grains and only the tip $A_0$ of the electrode is polished to a mirror surface by the second grinding part 3*b* with relatively fine abrasive grains with great efficiency.

It is also noted that, with electrode A held in the electrode holder 7, the end portion of the electrode is conically shaped and the tip $A_0$ is finished to a mirror surface using the same grinding machine for electrodes, and therefore, even when grinding is switched from conical form grinding to mirror polishing, there is no dislocation to the position of the axis of the electrode, and the tip $A_0$ can be finished to a mirror surface efficiently and precisely.

c. In the present invention, it is so arranged that the electrode holder 7 is moved exactly by a specific distance 1 by the swing plate moving mechanism 9 while watching the dial gauge 10. In addition, the turning driving force is transferred to electrode A by the endless rubber belt 15, which absorbs fluctuations in the distance 1 by shrinking or expanding. As a result, the electrode holder 7 is turned smoothly.

d. By merely inserting the spacer 16 in the electrode holder 7, it is possible to adjust the height of the tip end $A_0$ of the electrode A to a specific elevational position and to grind precisely the tip $A_0$ alone to a mirror surface.

e. In the present invention, the grinding disk is also formed integrally of grains with the same grain size (medium grain size), with the grinding area shaped to conform to the finished contour of the electrode. That makes the manufacture easy and reduces the cost of manufacture.

f. Also in the present invention, the axis of the electrode extends along a line perpendicular to the axis of the motor drive shaft. That substantially simplifies the construction and reduces the cost of manufacture as compared with such grinding machines in which the grinding disk itself is slanted against the electrode or the slant angle is adjusted.

g. In the present invention, it is possible to move the electrode holder by the swing plate moving mechanism while watching the dial gauge, which permits very precise positioning of the electrode in relation to the grinding disk.

What is claimed is:

1. A grinding machine for welding electrodes, said grinding machine comprising:

a box housing;

a grinder motor fixed in the housing;

a grinding disk provided with a grinding area and fixed on a drive shaft of said grinder motor;

a swing plate provided above the grinding disk and on the housing and supported movably in the direction of the axis $\phi$ of the drive shaft;

a cylindrical holder guide rotatably supported by the swing plate in a vertical position with a lower portion protruded above the grinding disk in the housing;

an electrode holder which is removably fitted into the holder guide, and which removably clamps an electrode with an end portion thereof in contact with the grinding area of the grinding disk;

an electrode turning motor which is fixed in the housing and which turns the holder guide with the electrode holder fitted therein; and a swing plate moving mechanism which moves the swing plate along the axis $\phi$ of the motor drive shaft by a specific distance L.

2. The grinding machine for welding electrodes as defined in claim 1, wherein the grinding area of the grinding disk is formed of a first grinding part made of coarse grains and a second grinding part made of fine grains.

3. The grinding machine for welding electrodes as defined in claim 1, wherein the grinding area of the grinding disk is made so that a first grinding part for shaping an end portion of the electrode in the form of a cone is provided on a front side of the disk while the second grinding part is provided with a V-shaped groove for polishing a tip of the conically formed end portion of the electrode to a mirror surface, wherein the V-shaped groove is provided on an outer peripheral portion of the disk.

4. The grinding machine for welding electrodes as defined in claim 1, wherein the grinding area of the grinding disk is constructed so such that a first grinding part for forming the end portion of the electrode in the form of a cone, and a second grinding part for polishing the tip of the conically formed end portion of the electrode to a mirror surface, are both provided on a front side of the disk respectively.

5. The grinding machine for welding electrodes as defined in claim 4, wherein said first grinding part is provided on an inner portion of the disk in the radial direction and on the front side thereof in the thickness direction, and the second grinding part is provided on an outer portion of the disk in the radial direction and on said front side thereof but recessed in the thickness direction.

6. The grinding machine for welding electrodes as defined in claim 5, wherein an inclination $\alpha_1$ angle of a longitudinally inclined surface defining the first grinding part is the same as that of a longitudinally inclined surface defining the second grinding part; wherein an inclination angle $\alpha_2$ of a transversely inclined surface defining the second grinding part is the same as that of a transversely inclined surface defining the second grinding part; and wherein a radius of an arc joint between the longitudinally inclined surface and the transversely inclined surface of the first grinding part is identical to that of an arc joint between a longitudinally inclined surface and a transversely inclined surface of the second grinding part.

7. The grinding machine for welding electrodes as defined in claim 1, wherein the grinding area of the grinding disk is integrally formed of grains with a medium grain size.

8. The grinding machine for welding electrodes as defined in claim 7, wherein the grinding area of the grinding disk is provided with a longitudinally inclined surface for shaping the end portion of the electrode in the form of a cone, a transversely inclined surface for discharging grinding dust, and a curved surface for polishing a tip $A_0$ of the electrode to a mirror surface.

9. The grinding machine for welding electrodes as defined in claim 1, wherein the grinding area of the grinding disk is formed symmetrically on each side of the base of the grinding disk.

10. The grinding machine for welding electrodes as defined in claim 1, wherein one end of the swing plate is pivotably fixed on an upper side of the housing in such a way that another end of the swing plate can be moved in the direction of the axis $\phi$ of the motor drive shaft.

11. The grinding machine for welding electrodes as defined in claim 1, wherein the electrode holder comprises a cylindrical chuck guide, a collet chuck to be inserted into an end side of a chuck guide and a cylindrical chuck screw inserted into the chuck guide from an upper side thereof and with a tip portion screwed into the collet chuck.

12. The grinding machine for welding electrodes as defined in claim 11, wherein a spacer with a specific thickness h is put on the chuck guide of the electrode holder so that a tip of the electrode is positioned within a grinding groove of the second grinding part.

13. The grinding machine for welding electrodes as defined in claim 1, wherein the holder guide with the electrode holder held therein is turned by the electrode turning motor via an endless rubber belt.

14. The grinding machine for welding electrodes as defined in claim 1, wherein the swing plate moving mechanism comprises a moving handle and a worm gear which is turned by the moving handle and engages with a thread provided on the swing plate.

15. The grinding machine for welding electrodes as defined in claim 14, wherein the distance L by which the electrode holder is moved by the swing plate moving mechanism is indicated by a dial gauge having a drive body which is interlocked with a gauge stopper provided on the swing plate.

* * * * *